US009134702B2

(12) United States Patent
Kasapi et al.

(10) Patent No.: US 9,134,702 B2
(45) Date of Patent: Sep. 15, 2015

(54) MECHANISM PREVENTING RATE VARIATIONS CAUSED BY GRAVITY ON A BALANCE-SPRING REGULATING DEVICE AND TIMEPIECE INCORPORATING THIS IMPROVEMENT

(75) Inventors: Carole Kasapi, La chaux-de-Fonds (CH); Patrick Pichot, Villers-le-Lac (FR)

(73) Assignee: CARTIER CREATION STUDIO S.A., Geneva (CH)

( * ) Notice: Subject to any disclaimer, the term of this patent is extended or adjusted under 35 U.S.C. 154(b) by 0 days.

(21) Appl. No.: 14/123,818

(22) PCT Filed: May 24, 2012

(86) PCT No.: PCT/IB2012/001008

§ 371 (c)(1), (2), (4) Date: Dec. 4, 2013

(87) PCT Pub. No.: WO2012/168773

PCT Pub. Date: Dec. 13, 2012

(65) Prior Publication Data

US 2014/0098647 A1 Apr. 10, 2014

(30) Foreign Application Priority Data

Jun. 9, 2011 (EP) ..... 11004697

(51) Int. Cl.

| | |
|---|---|
| ***G04B 15/00*** | (2006.01) |
| ***G04C 5/00*** | (2006.01) |
| ***G04B 17/00*** | (2006.01) |
| ***G04B 17/28*** | (2006.01) |

(52) U.S. Cl.

CPC ..... *G04B 17/28* (2013.01); *G04B 17/00* (2013.01); *G04B 17/285* (2013.01)

(58) Field of Classification Search

CPC ..... G04B 17/00; G04B 17/28; G04B 17/285
USPC ..... 368/124, 127, 129–133
See application file for complete search history.

(56) References Cited

U.S. PATENT DOCUMENTS

| | | | | |
|---|---|---|---|---|
| 5,278,806 | A * | 1/1994 | Affolter | 368/204 |
| 2006/0007789 | A1 * | 1/2006 | Papi | 368/127 |

(Continued)

FOREIGN PATENT DOCUMENTS

| | | | |
|---|---|---|---|
| EP | 1 615 085 | A1 | 1/2006 |
| EP | 2 031 465 | A1 | 3/2009 |
| EP | 2 124 111 | A1 | 11/2009 |

OTHER PUBLICATIONS

International Search Report, dated Oct. 12, 2012, from corresponding PCT application.

*Primary Examiner* — Amy Cohen Johnson
*Assistant Examiner* — Daniel Wicklund
(74) *Attorney, Agent, or Firm* — Young & Thompson

(57) ABSTRACT

The mechanism preventing rate variations caused by the effect of gravity on a regulating member (2, 3) of a timepiece movement comprises a regulating member comprising a balance-spring (2) and an escapement wheel (3) which are mounted on a platform (4). This platform (4) comprises an unbalance and is mounted so as to freely rotate about at least one first axis (A-A) with respect to a plate (1) of the movement so that the platform (4) rotates about said first axis (A-A) under the effect of the Earth's gravity. The mechanism comprises a going train comprising a kinematic drive chain (M) arranged to connect the escapement wheel (3) to a barrel system (10) of the timepiece as well as a kinematic correcting chain (C) which compensates for the displacements and speed of the platform (4) with respect to the plate (1). This mechanism is characterized in that it further comprises a regulator device comprising a regulator member (50) connected to the platform (4) and driven by the relative movements between the platform (4) and the plate (1) of the timepiece movement.

15 Claims, 6 Drawing Sheets

(56) References Cited

U.S. PATENT DOCUMENTS

| | | | | |
|---|---|---|---|---|
| 2008/0074955 | A1* | 3/2008 | Golay et al. | 368/127 |
| 2009/0274012 | A1* | 11/2009 | Kasapi et al. | 368/127 |
| 2010/0002548 | A1* | 1/2010 | Hessler et al. | 368/129 |
| 2010/0091617 | A1* | 4/2010 | Goeller et al. | 368/127 |
| 2010/0238769 | A1* | 9/2010 | Zaugg et al. | 368/127 |
| 2010/0246338 | A1* | 9/2010 | Calabrese et al. | 368/127 |
| 2011/0026373 | A1* | 2/2011 | Kasapi et al. | 368/127 |
| 2011/0079099 | A1* | 4/2011 | Himmelmann et al. | 74/411.5 |

* cited by examiner

MECHANISM PREVENTING RATE VARIATIONS CAUSED BY GRAVITY ON A BALANCE-SPRING REGULATING DEVICE AND TIMEPIECE INCORPORATING THIS IMPROVEMENT

BACKGROUND OF THE INVENTION

The known mechanisms preventing rate variations caused by gravity on a balance-spring regulating device as described for example in patent EP 2 124 111 of the patentee, but also as described for example in documents EP-A-2031465 or EP-A-1615085, are disadvantageous in that the balance-spring is subjected to high accelerations caused by the movements of the mobile platform bearing this balance-spring during sudden movements of the wearer of the watch. These accelerations can cause a knocking phenomenon in the balance which causes a rate variation in this regulating device, generally a gain therein.

SUMMARY OF THE INVENTION

The aim of the present invention is to improve these existing mechanisms by adding a device thereto preventing strong accelerations from being transmitted to the balance-spring when the watch is subjected to movements of the user.

The object of the present invention is a mechanism preventing rate variations caused by the effects of gravity on a regulating member of a timepiece movement comprising a balance-spring and an escapement wheel which are mounted on a platform, said platform comprising an unbalance and being mounted so as to freely rotate about at least one first axis with respect to a plate of the movement so that this platform rotates about said first axis under the effect of the Earth's gravity; said mechanism comprising a going train comprising a kinematic drive chain connecting the escapement wheel to a barrel of the timepiece movement as well as a kinematic correcting chain which compensates for the movements and speed of the platform with respect to the plate, characterised in that it comprises a regulating device comprising a regulating member connected to the platform and driven by the relative movements between the platform and the plate of the timepiece movement.

The additional features of this device constituting the improvement are stated in the dependent claims.

BRIEF DESCRIPTION OF THE DRAWING FIGURES

The accompanying drawing schematically illustrates by way of example different embodiments of the device in accordance with the invention.

FIG. 1 illustrates partially and schematically an embodiment of a mechanism preventing rate variations caused by gravity allowing the balance to be stabilised about an axis in parallel with the staff of this balance and able to be combined with a regulating device.

FIG. 1*a* is a block diagram of a variation of the mechanism illustrated in FIG. 1.

DETAILED DESCRIPTION OF THE INVENTION

Figure 1:
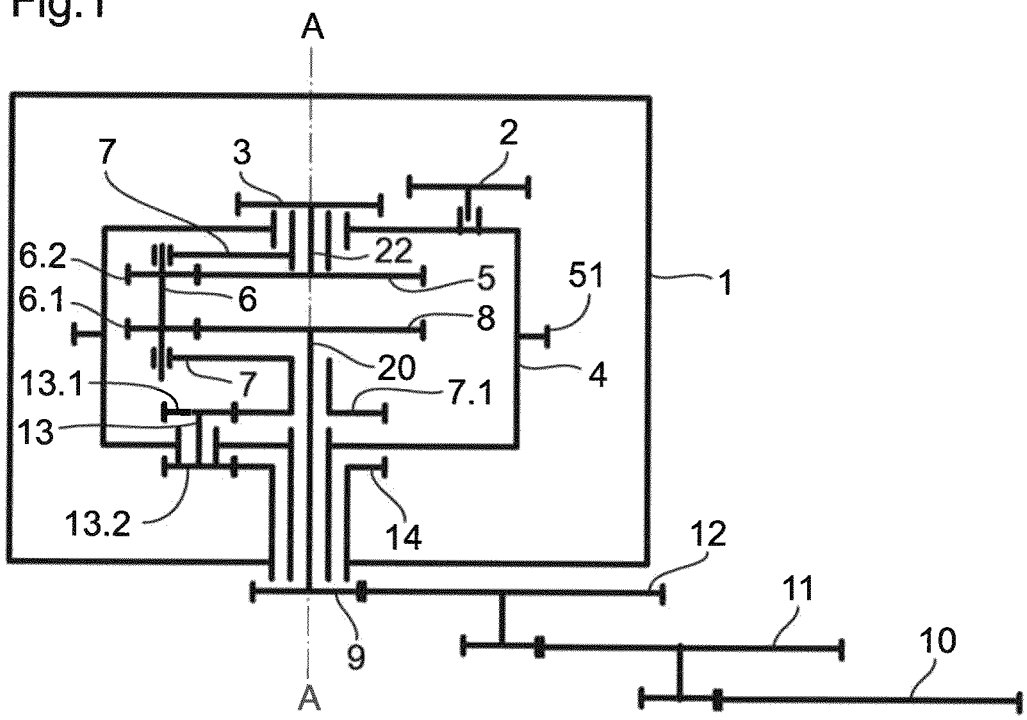

FIGS. 1 to 6 illustrate partially and schematically three examples of mechanisms preventing rate variations caused by gravity preventing rate variations or deviations in a regulating device of the balance-spring type of a timepiece such as a wristwatch or a pocket-watch caused by the effect of the Earth's gravity resulting from changes in the spatial orientation of the regulating device. For this purpose, the mechanism comprises means allowing the regulating device to remain in a stable spatial position despite the movements which the wearer imparts to the timepiece, whilst ensuring that the time display is not disrupted. Preferably, the stable spatial position of the regulating device is a position for which the balance remains in a horizontal or vertical reference plane whatever the position of the watch.

In accordance with the present invention, such a mechanism further comprises a regulator device comprising at least one regulator member connected to the platform bearing the regulator device (preferably via an inertial kinematic chain) as described below with reference to FIGS. 7 and 8. However, for ease of understanding of the present invention, three examples of mechanisms preventing rate variations caused by gravity are described, firstly with reference to FIGS. 1 to 6.

The principle of such mechanisms preventing rate variations consists of mounting the regulating member, generally the balance-spring, the pallets and the escapement wheel on a platform which is rotatable on one or two axes orthogonal to the plate of the watch movement, this platform being subjected to the action of an unbalance which thereby allows said platform to be held in a fixed reference plane (either horizontal, vertical or possibly inclined) by the action of the Earth's gravity whatever the position of the watch and thus of its movement.

A going train of this mechanism comprises a kinematic drive chain connecting the escapement wheel to the barrel system as well as a kinematic correcting chain which compensates for the movements and speeds of the platform with respect to the plate so that these movements of the platform do not adversely affect the chronometry of the timepiece. In particular, as will be seen hereinafter, by virtue of this kinematic correcting chain, when the platform starts to rotate under the effect of its unbalance, it is possible to counteract the effect of the displacements and speed of the platform on the main kinematic drive chain.

A feature of the mechanisms illustrated in FIGS. 1 to 6 is that in each case the going train, and in particular the kinematic drive and correcting chains, has the feature of comprising only epicycloidal gear trains, the mobiles of which mesh in the manner of a spur gear. Another important feature of these mechanisms resides in the fact that a mobile of the main kinematic drive chain is mounted in a planetary gear holder rotating about two coaxial drive spindles mounted or not on a mobile unit comprising the platform bearing the balance and a frame pivoted on the plate of the movement on which said platform is pivoted. In this manner, these mechanisms consume little energy, which enables the weight of the unbalance of the platform to be reduced and ensures that there is no important reduction of the power reserve of the timepiece movement.

In accordance with another feature of the mechanisms illustrated in FIGS. 1 to 6, the kinematic correcting chain connects the escapement wheel to the plate and comprises at least one mobile which pivots on the plate, which advantageously reduces the effect of the weight of this correcting chain on the unbalanced platform. In accordance with yet another feature of these mechanisms, the seconds wheel is mounted on the platform, which greatly minimises the influence which the rotation of the platform may have on the torque transmitted to the escapement by the main kinematic drive chain.

Notwithstanding the above statements, it should be stated that different embodiments and variations of the mechanism preventing rate variations in the regulating device of a timepiece movement, which will now be described, are given by way of non-limiting example.

The first embodiment of the mechanism preventing rate variations in a regulating device of a timepiece movement is illustrated in FIG. 1. It is a simplified mechanism in that the platform bearing the regulating device is mounted so as to rotate freely on the plate of the movement on a single rotational axis A-A perpendicular to the plane of the plate 1 of the timepiece movement.

The regulating device comprising a balance 2, pallets (not shown) and an escapement wheel 3 is supported on a platform 4 pivoted on the plate 1 of the movement concentric to the axis A-A. As illustrated in the figures, the rotational axis A-A of the platform 4 comprises a first drive shaft 20 and a second drive shaft 22, the platform being formed such that these two drive shafts rotate about this same axis A-A. In this embodiment, the staff of the balance 2 is in parallel with this rotational axis A-A of the platform 4.

The escapement wheel 3, pivoted coaxially to the axis A-A on the platform 4, is fixedly attached to a driving wheel or second drive wheel 5 connected to the escapement wheel by the second drive shaft 22. This second drive wheel 5 is engaged with the first mobile 6.2 of a planetary gear 6 pivoted idly in a planetary gear holder 7 which is itself pivoted on the platform 4 and caused to rotate about the axis A-A by a wheel 7.1 of the planetary gear holder. Similarly, the planetary gear holder 7 effectively forms a frame rotating concentrically with the platform 4 and in which the planetary gear mobile 6 is mounted idly. As will be seen hereinafter, the rotational speed of this planetary gear holder 7 is a function of the rotational speed of the platform 4 about the axis A-A.

The second mobile 6.1 of the planetary gear 6, fixedly attached to and coaxial with the first mobile 6.2 of this planetary gear 6 is engaged with a first drive wheel 8 fixedly attached to the first drive shaft 20 pivoted on the plate 1 of the movement. The wheel 8 and the shaft 20 are fixedly attached to the seconds wheel 9 of the drive going train of the timepiece movement. In a conventional manner, this seconds wheel 9 is kinematically connected to the barrel system 10 of the timepiece movement via the third wheel 12 and the centre wheel 11, all pivoted on the plate 1 of the timepiece movement on axes in parallel with the axis A-A.

The escapement wheel 3 is thus connected to the barrel 10 by a main kinematic drive chain comprising an epicycloidal spur gear train formed by the driving wheel 5, the first 6.1 and second 6.2 mobiles of the planetary gear 6, the first drive wheel 8, the seconds wheel 9, the third wheel 12, the centre wheel 11 and the barrel 10. This main kinematic drive chain does not comprise any conical intermediate wheel and thus has a very high efficiency, for example an efficiency which is substantially equal to the drive going train of a conventional mechanical watch.

When displacement of the timepiece bearing this mechanism causes rotation of the platform 4 about the axis A-A, in the absence of the kinematic correcting chain, the mobiles of the main kinematic drive chain are rotationally driven which would cause perturbations in the display of the time and in particular on the escapement.

To overcome the effects of these perturbations, a mobile of the main kinematic drive chain, in this case the mobile 6, is mounted idly in the planetary gear holder 7, the latter forming part of a kinematic correcting chain also comprising the wheel 7.1 of the planetary gear holder, an idle mobile 13 pivoted on the platform 4 along an axis in parallel with the axis A-A, and a fixed wheel 14 concentric to the axis A-A and fixedly attached to the plate 1 of the movement. The idle mobile 13 comprises a first wheel 13.1 meshing with the wheel 7.1 of the planetary gear holder and a second wheel 13.2 (fixedly attached to and coaxial with the wheel 13.1) engaged with the fixed wheel 14.

Therefore, by virtue of the kinematic correcting chain comprising the fixed wheel 14, the idle mobile 13, the wheel 7.1 of the planetary gear holder, and the planetary gear holder 7 bearing the planetary gear 6, when the platform 4 starts to rotate, the planetary gear holder 7 is rotationally driven with a speed $V^7$ which is a function of the speed of the platform 4 $V^4$ (these speeds being relative to a fixed reference). This relationship depends upon the transmission ratio between the wheels 14, 13.2, 13.1 and 7.1, particularly:

$$V^7 = (1 - k_1) \cdot V^4$$

or $$k_1 = \frac{R_{14} \cdot R_{13.1}}{R_{13.2} \cdot R_{7.1}}$$

where Rx is the number of teeth in wheel X.

A careful choice of the different gear ratios means that the mobile 6 is caused to rotate about the axis A-A so as to overcome the effect of the displacements and speed of the platform 4 on the main kinematic drive chain. In particular, if $V^9$ is the speed of the third wheel at the output of the platform and $V^U$ is the useful speed transmitted to the escapement (these speeds again being relative to a fixed reference), then the following equation is obtained:

$$V^9 = \frac{1}{k_2}[V^U + (k_1 + k_2 - k_1 \cdot k_2) \cdot V^4]$$

or $$k_2 = \frac{R_8 \cdot R_{6.2}}{R_{6.1} \cdot R_5}$$

To make $V^9$ independent of $V^4$, the term $(k_1+k_2-k_1 \cdot k_2)$ just needs to be cancelled. The equation to be satisfied thus becomes:

$$(k_1+k_2-k_1 \cdot k_2)=0, \text{ with } k_1 \neq 1 \text{ and } k_2 \neq 1$$

The unbalance of the platform 4 can be formed by the regulating device—balance-spring and escapement—itself since it can be mounted on the platform 4 offset with respect to the rotational axis A-A thereof. This avoids increasing the weight of the timepiece movement. Of course, in variations a weight or mass could be eccentrically fixed with respect to the axis A-A on the platform 4 to increase the unbalance thereof.

Figure 1A:
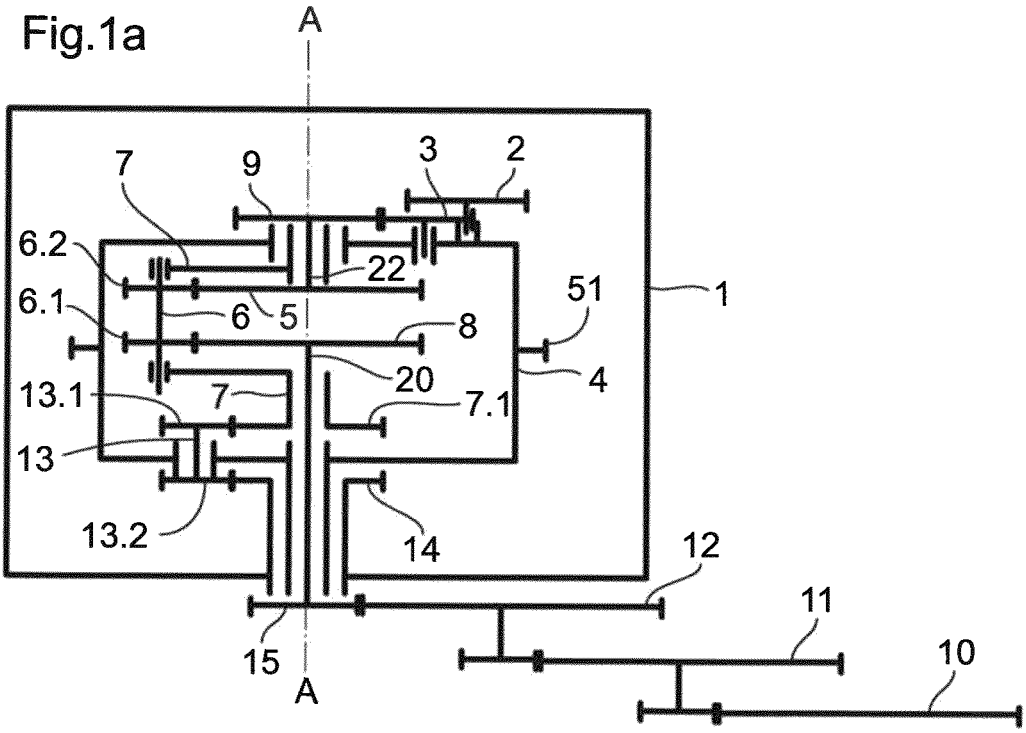

FIG. 1*a* illustrates a variation of the mechanism described with reference to FIG. 1. In this variation, the seconds wheel 9 of the going train of the movement is mounted on the platform 4 and meshes with the pinion of the escapement wheel 3. Therefore, it is no longer the axis of the escapement wheel 3 which is coaxial with the rotational axis A-A of the platform 4 but the axis of the seconds wheel 9, the balance 2 and the escapement wheel 3 being pivoted on the platform 4 in parallel with the axis A-A.

In this embodiment, it is the seconds wheel 9 which is fixedly attached to and concentric with the driving wheel 5 via the second drive shaft 22. The first drive wheel 8 is itself fixedly attached by the first drive shaft 20 to a third drive wheel 15 engaged with the third wheel 12.

By mounting a mobile of the conventional drive going train, in this case the seconds wheel 9, on the platform 4, the influence which the rotation of the platform 4 can have on the torque transmitted to the escapement by the main kinematic drive chain is greatly minimised. Of course, a second or even a third mobile of the conventional drive going train can be mounted on the platform 4; the higher the number of mounted mobiles, the less effect the rotation of the platform 4 has on the torque transmitted from the barrel 10 to the escapement wheel 3. It should be noted in this embodiment that the speed $V^U$ mentioned above becomes the useful speed transmitted to the first mobile mounted on the platform 4, thus the seconds wheel 9 in FIG. 1*a*.

Figure 2:
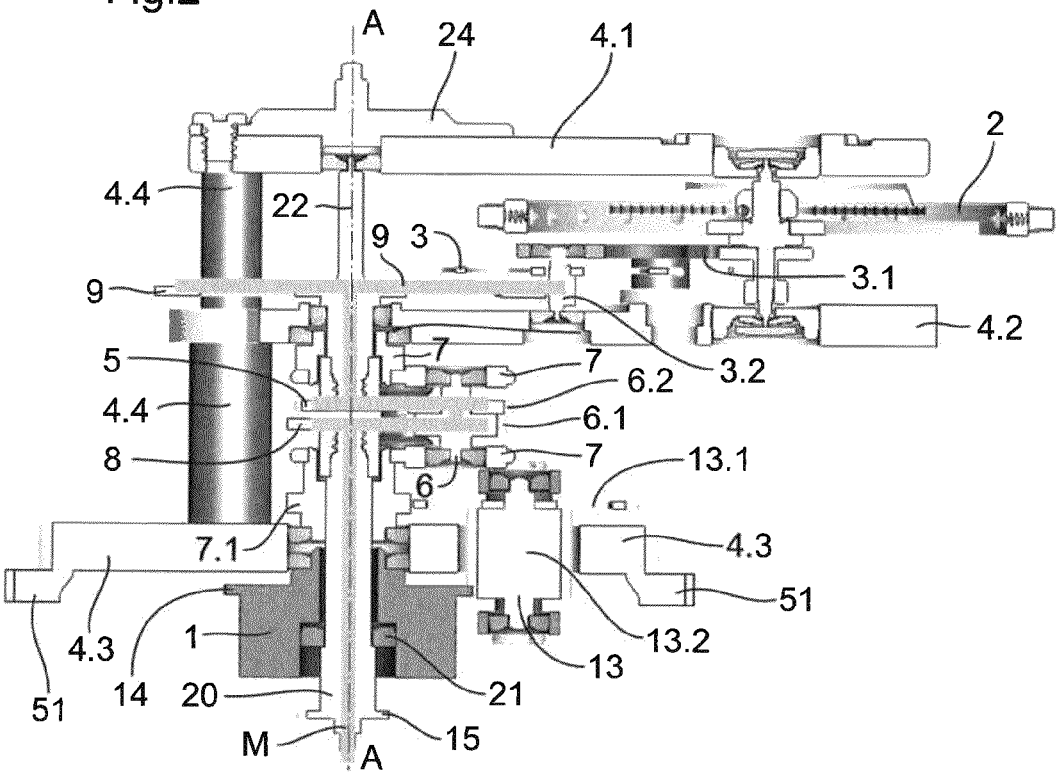
FIG. 2 illustrates a structure corresponding to the block diagram in FIG. 1*a* showing the main drive chain.
Figure 3:
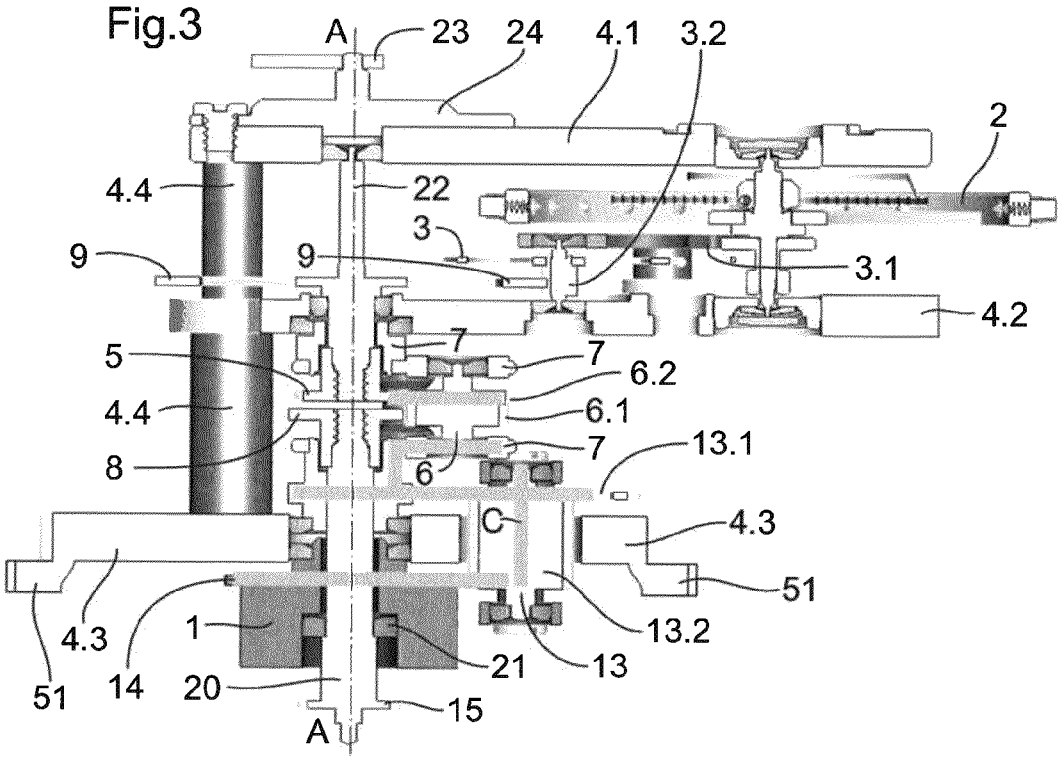
FIG. 3 illustrates the structure illustrated in FIG. 2 showing the corrective chain.
Figure 4:
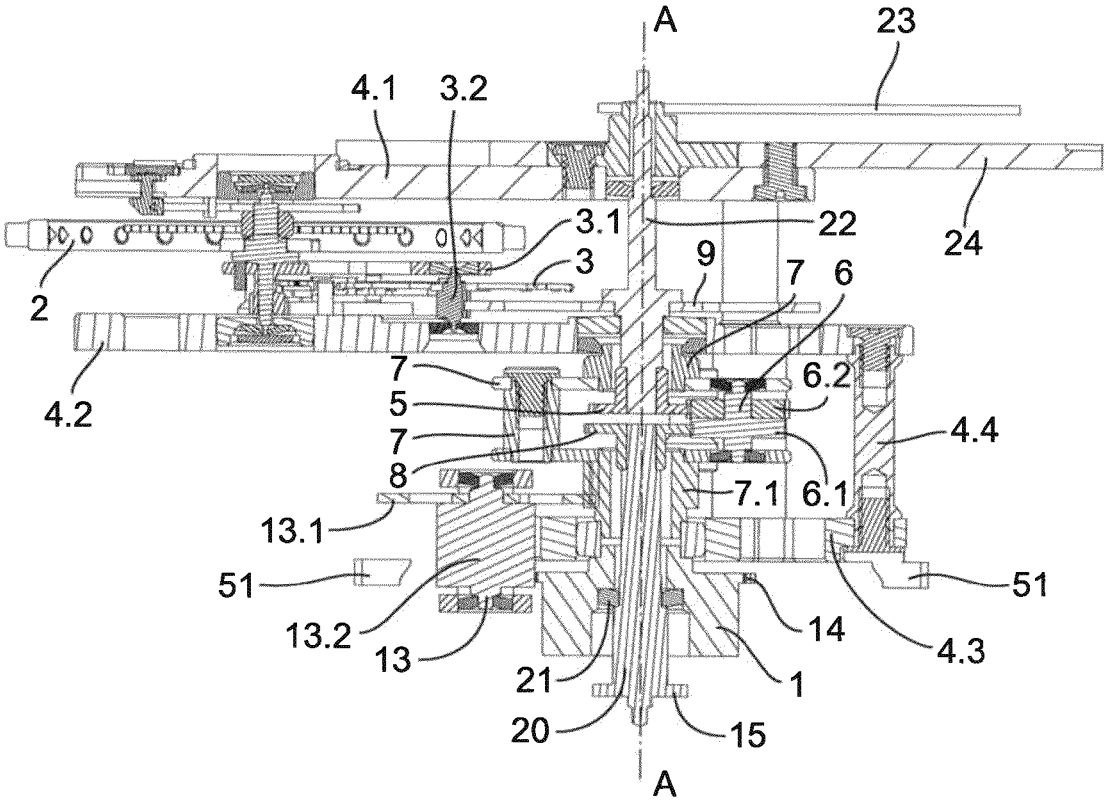
FIG. 4 is a sectional view of the structure illustrated in FIGS. 2 and 3.

FIGS. 2, 3 and 4 illustrate by way of example a practical form of the embodiment of the mechanism described with reference to the block diagram in FIG. 1*a*, i.e., for stabilisation about a single axis A-A of the platform 4 bearing the regulating device 2, 3 and the seconds wheel 9.

The platform 4 is formed by an upper bridge 4.1, an intermediate bridge 4.2, bearing an escapement bridge 3.1, and a lower bridge 4.3 pivoted on the plate 1 concentric to the axis A-A.

The three bridges 4.1, 4.2 and 4.3 of the platform 4 are fixedly connected together by columns 4.4, which ensures that all these elements of the platform rotate freely together with respect to the plate.

The third drive wheel 15 is fixedly attached to the lower end of the first drive shaft 20 pivoted by a bearing 21 in the plate 1, the shaft 20 being freely rotatable with respect to the plate as shown above. This first drive spindle 20 has the first drive wheel 8 at its upper end.

The fixed wheel 14 of the plate 1 meshes with the second wheel 13.2 of the idle mobile 13 whilst the first wheel 13.1 of this idle mobile, pivoted idly on the lower bridge 4.3 meshes with the wheel of the planetary gear holder 7.1 of the lower hub of the planetary gear holder 7 pivoted in the lower bridge 4.3 concentrically to the axis A-A about the first drive shaft 20. The planetary gear 6 is pivoted idly on the planetary gear holder 7, the second wheel 6.1 of the planetary gear 6 meshes with the first drive wheel 8, while the first wheel 6.2 of the planetary gear 6 meshes with the driving wheel or second drive wheel 5 which is fixedly attached to the lower end of the second drive shaft 22 pivoted on the intermediate bridge 4.2 of the platform 4. This second drive shaft 22 bears the seconds wheel 9 which is engaged with the pinion 3.2 of the escapement wheel 3. This FIG. 2 shows the path of the main kinematic drive chain M connecting the third drive wheel 15, connected by the drive going train to the barrel, to the escapement wheel 3 via the planetary gear 6 and the seconds wheel 9.

FIG. 3 shows the path of the kinematic correcting chain C connecting the planetary gear holder 7 to the plate 1 via the wheel 7.1 of the planetary gear holder, the idle mobile 13 and the fixed wheel 14.

FIG. 4 is sectional view of the mechanism illustrated in FIGS. 1*a*, 2 and 3.

The second drive shaft 22 is extended beyond the intermediate bridge 4.2 of the platform 4 and is also pivoted in the upper bridge 4.1 of this platform 4. In this variation of the first embodiment of the mechanism in which the seconds wheel 9 is mounted on the platform 4, the free upper end of this second drive shaft 22 is extended beyond the upper bridge 4.1 and bears a seconds hand 23 co-operating with a seconds dial 24 supported by the upper face of the upper bridge 4.1 of the platform 4.

In such an embodiment, the seconds dial 24 rotates about the axis A-A depending on the displacements of the platform 4. The seconds hand 23 also rotates depending on the displacements of the platform but it is additionally rotationally driven, with respect to the dial 24, by the main kinematic drive chain. In this manner, at any given time or if the movement of the watch is stopped, this seconds hand 23 remains stationary with respect to the seconds dial 24 even though the dial rotates about the axis A-A.

The hour and minutes are displayed in the conventional manner from a mobile of the drive going train of the timepiece movement, generally the centre wheel 11 or the middle wheel 12, by motion work for driving the hour and minutes hands which co-operate with a fixed dial with respect to the plate of the timepiece movement.

The previously described display of the seconds within the scope of the mechanism is original and ludic as it rotates on itself upon each movement of the platform, i.e., each time that the spatial orientation of the watch changes due to movements of the wearer of this watch.

By virtue of this mechanism preventing rate variations in a regulating device, it is possible to keep, via the gravitational effect acting on the unbalance of the platform 4, the balance in a fixed reference plane, which is preferably horizontal or vertical but can also be inclined, whatever the spatial orientation of the plate 1 about the axis A-A. Thus, the movements imparted by the wearer of the watch about this axis A-A generally no longer have an influence on the rate of the regulating device which always works under the same conditions. The presence of a single and unique correcting chain is sufficient to overcome the influence of the displacements and speed of the platform 4 on the escapement wheel 3 and thus on the regulating device and on the time display since they are fully compensated for. In the embodiment where the seconds wheel 9 is mounted on the platform, stray torques which can be caused by the movements of the platform 4 on the escapement wheel are further reduced.

Figure 5:
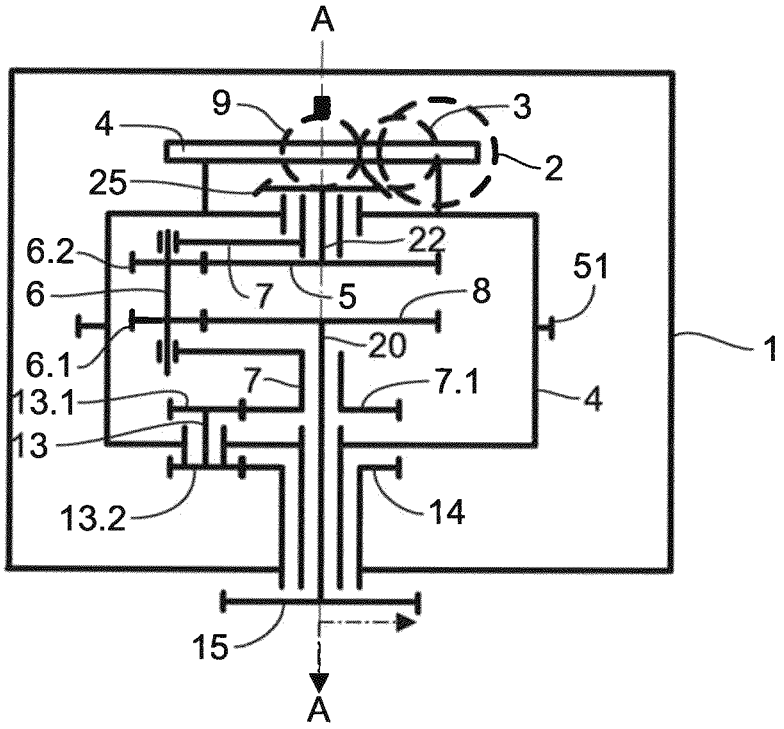
FIG. 5 illustrates partially and schematically a second embodiment of the mechanism allowing the balance to be stabilised about an axis orthogonal to the staff of the balance and able to be combined with a regulating device.

FIG. 5 illustrates partially a second exemplified embodiment of the mechanism preventing rate variations in the regulating device of a timepiece movement in which the platform 4 is stabilised about a rotational axis A-A orthogonal to the staff of the balance 2. In this embodiment, the staff of the balance 2, the axis of the escapement wheel 3 and the axis of the mounted seconds wheel 9 are all perpendicular to the rotational axis A-A of the platform 4. In this embodiment, in addition to the elements already described with reference to FIGS. 1 to 4, the correcting mechanism has a conical intermediate wheel 25 fixedly attached to the driving wheel or second drive wheel 5 which meshes with the seconds wheel 9.

For the remainder, the mechanism is identical to that of the first embodiment in the variation described in FIGS. 1*a* to 4. In this embodiment, the axis A-A about which the platform rotates can be, for example, the 3 o'clock-9 o'clock axis of the watch.

Figure 6:
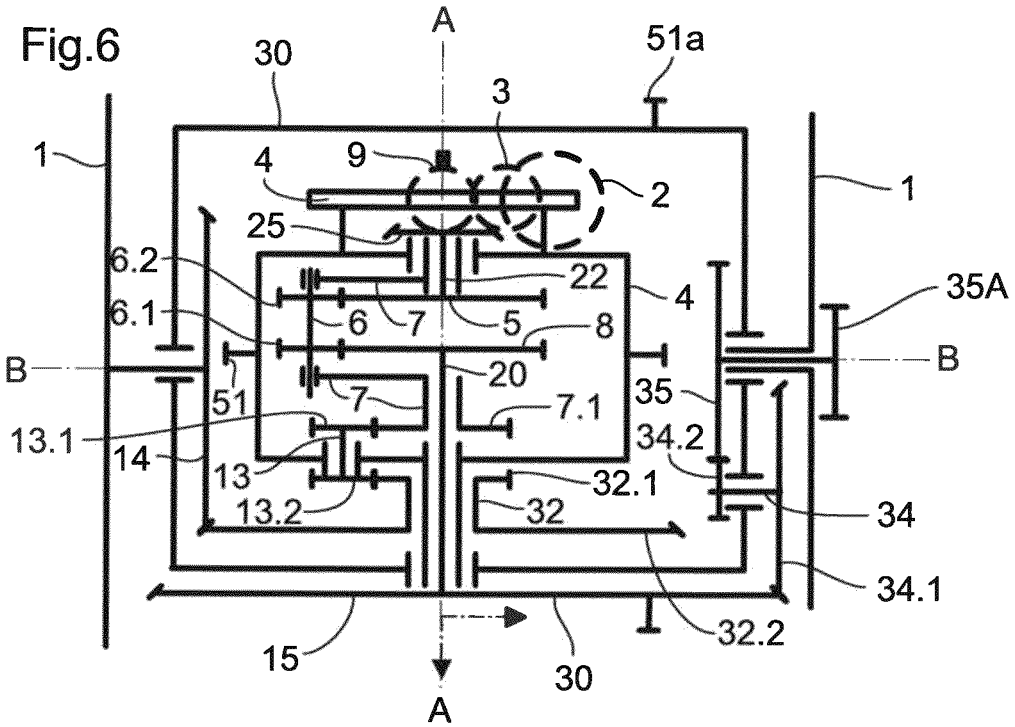
FIG. 6 illustrates partially and schematically a third embodiment of the mechanism allowing the balance to be stabilised about two axes orthogonal to the staff of the balance and able to be combined with a regulating device.

The third exemplified embodiment of a mechanism preventing rate variations in a regulating member of a timepiece movement illustrated schematically in FIG. 6 allows the stabilisation of the platform 4 bearing the balance 2 about two rotational axes A-A and B-B which are orthogonal to each other and to the rotational axis of the balance 2. Such a mechanism allows the platform 4 bearing the regulating device of the watch to be kept in a fixed reference plane whatever the spatial orientation of the plate 1 of the movement of the watch and no longer just with respect to a single axis of displacement.

This mechanism has a frame 30 pivoted on the plate 1 about a second rotational axis B-B. The platform 4 of FIG. 5, previously described, is mounted on this frame 30 so as to rotate about the first rotational axis A-A perpendicular to the second rotational axis B-B of the frame 30.

As in the embodiment described with reference to FIG. 5, the platform 4 bears the balance 2, the escapement wheel 3 and the seconds wheel 9, the axes of which are mutually parallel and orthogonal to the first A-A and second B-B rotational axes.

The seconds wheel 9 meshes with the conical intermediate wheel 25 fixedly attached to the drive wheel or second drive wheel 5 pivoted on the platform 4 concentrically to the first rotational axis A-A about which said platform 4 rotates. As described previously, this driving wheel 5 meshes with the first wheel 6.2 of the planetary gear 6, whose planetary gear holder 7 frame pivots about the first rotational axis A-A on the platform 4. The second wheel 6.1 of the planetary gear meshes with the first drive wheel 8 pivoted concentrically to the first rotational axis A-A on the frame 30 which for its part is pivoted about the second rotational axis B-B on the plate 1. This first drive wheel 8 is fixedly attached to the third drive wheel 15, both pivoted on the frame 30.

The planetary gear holder 7 is engaged, by way of the wheel 7.1 of the planetary gear holder, with the first wheel 13.1 of the idle mobile 13 pivoted idly on the platform 4, the second wheel 13.2 of which meshes with the first wheel 32.1 of a correcting mobile 32, the second wheel 32.2 of which has conical toothing. This correcting mobile 32 is pivoted on the platform 4, in particular about the first drive shaft 20 concentrically to its rotational axis A-A on the frame 30. This correcting mobile 32 meshes by way of its second wheel 32.2 with the fixed wheel 14 fixedly attached to the plate 1. In this embodiment, the fixed wheel 13 thus has conical toothing.

The third drive wheel 15 also has conical toothing and meshes with the first wheel 34.1 with conical toothing of a second idle mobile 34 pivoted idly on the frame 30. The second wheel 34.2 of this second idle mobile 34 is engaged with a fourth drive wheel 35 pivoted concentrically to the second rotational axis B-B on the frame 30. This fourth drive wheel 35 is fixedly attached to a fifth drive wheel 35A kinematically connected to the barrel 10 by a drive going train of the movement which may have a centre wheel 11 and a middle wheel 12 for example (these latter elements are not shown in FIG. 6 for simplicity).

In this third embodiment, the platform 4 which bears the regulating drive 2, 3 thus has two degrees of freedom: rotation about a first axis A-A and rotation about a second axis B-B orthogonal to the first axis A-A. The platform 4 having an unbalance, formed by the regulating device 2, 3 or by an additional unbalance may thus move based on any spatial orientation of the plate 1 of the movement to ensure that the plate is kept in a fixed reference plane of the balance 2 and thus to prevent rate variations caused by gravity whatever the position of the watch or the movements imparted thereto.

In this embodiment, the main kinematic drive chain comprises the fifth drive wheel 35A, the fourth drive wheel 35, the second idle mobile 34, the third drive wheel 15, the first drive wheel 8, the planetary gear 6, the driving wheel (or second drive wheel) 5 and the conical intermediate wheel 25 as well as the seconds wheel 9 and the escapement wheel 3.

The kinematic correcting chain, for its part, comprises in this embodiment the fixed wheel 14, the correcting mobile 32, the first idle mobile 13, the wheel 7.1 of the planetary gear holder and the planetary gear holder.

For all these mechanisms, in order to more effectively prevent high accelerations from being transmitted to the regulating member, the balance-spring 2, during movements of the platform 4 caused by the change in orientation of the watch according to the movements of the wearer of this watch, a mechanism in accordance with the invention further comprises a regulator device connecting the platform 4 to a regulator member such as an inertia flywheel 50, preferably via an inertial kinematic chain. This regulator device imparts to the platform greater rotational inertia so as to make operation of the balance more regular by counteracting the jerks caused by accelerations of the wearer.

Figure 7:
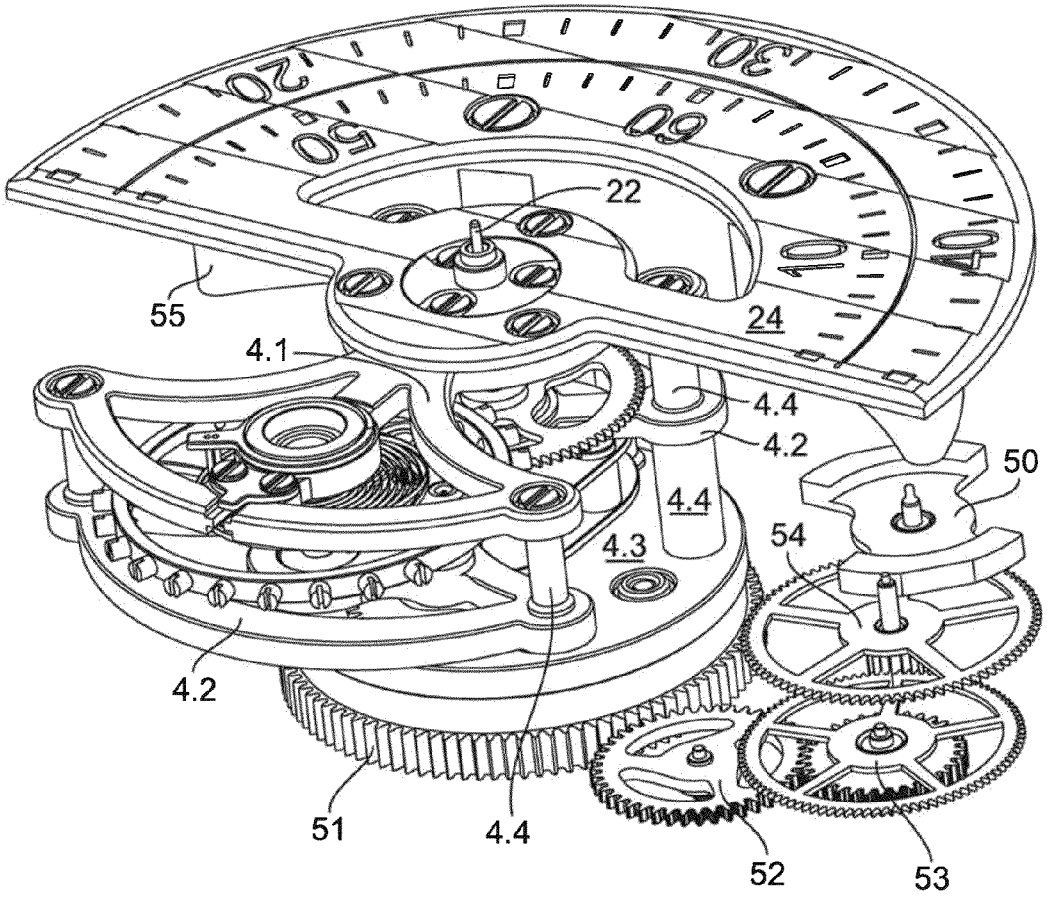
FIG. 7 is a partial perspective view of the mechanism illustrated in FIGS. 1*a*, 2 and 3 in combination with the regulating device comprising an inertial kinematic chain driving an inertia flywheel in accordance with one embodiment of the invention.
Figure 8:
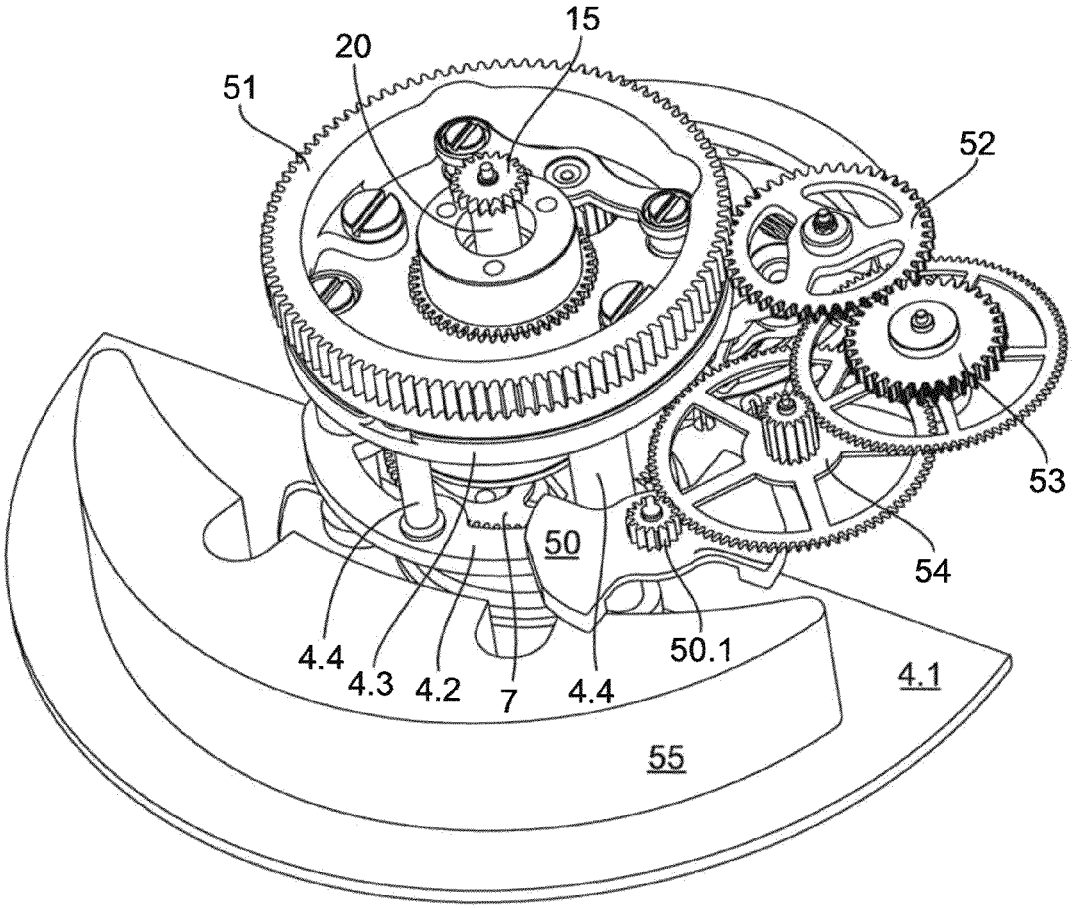
FIG. 8 is a perspective view corresponding to that of FIG. 7, as seen from another angle.

In accordance with one embodiment of the invention, FIGS. 7 and 8 illustrate partially the mechanism of FIGS. 1A to 4 provided with a regulator device. This inertial kinematic chain has a toothed ring 51 fixedly attached with and coaxial to the platform 4 meshing with a first mobile 52 pivoted on the plate 1 or a bridge of the timepiece movement. This first mobile 52 drives an inertia flywheel 50 via a second mobile 53 and a third mobile 54 engaged with a pinion 50.1 of the inertia flywheel. The second 53 and third 54 mobiles of this inertial kinematic chain are also pivoted on the plate 1 or a bridge of the timepiece movement like the inertia flywheel 50. In one variation, the inertial kinematic chain may comprise only one intermediate mobile between the toothed ring 51 and the flywheel 50. In yet another variation, the flywheel 50 may mesh directly with the toothed ring 51 but in this case the flywheel must be much bigger.

By virtue of this regulator device, it is possible to better prevent knocking of the balance by greatly decreasing the accelerations of the platform by increasing its inertia without thereby increasing its mass.

In one variation, it is feasible to mount the inertia flywheel 50 and its inertial kinematic chain on the platform 4. In this case it is necessary to provide a differential on the platform 4. The inputs of this differential are then a fixed wheel on the plate 1 and the toothed ring 51 fixedly attached to the platform 4 and the inertial kinematic chain leading to the inertia flywheel 50 forms the output of this differential.

The regulator device comprising an inertial kinematic chain connecting the platform 4 to the inertia flywheel 50 allows the variations in acceleration of the movement of the platform 4 to be reduced and prevents knocking of the balance 2.

It should be noted that this inertial kinematic chain driving the regulator member by relative movements between the platform and the plate of the timepiece movement is independent of the kinematic drive or correcting chains of the mechanism and also of the kinematic chain for automatic winding if the platform 4 acts as a winding mass. This device allows the inertia of the inertia flywheel 50 to be returned to the platform 4 multiplied by the square of the reduction ratio of the inertial kinematic chain. This solution is particularly effective at reducing the acceleration effects of the platform by increasing the inertia without increasing its mass.

In a particular manner, the multiplication ratio of the inertial kinematic chain is between 50 and 500, preferably equal to 100 for the embodiment previously described with reference to FIGS. 7 and 8.

Generally speaking, the higher the multiplication ratio of this inertial kinematic chain, the smaller the inertia flywheel, and the lower the inertia thereof, may be.

For this regulator device, the inertia of the flywheel multiplied by the squared ratio of the inertial kinematic chain is 10 to 50 times the inertia of the platform. Preferably, and for an embodiment like one described previously, a value of 20 times the inertia of the platform is obtained.

In one variation, the flywheel 50 and the intermediate mobiles of the inertial kinematic chain may be mounted on the platform 4, the first intermediate mobile 52 meshing with a fixed wheel on the plate or a bridge of the timepiece movement.

In the illustrated example, the platform 4 is provided with an automatic winding mass 55 and the mechanism has a conventional automatic winding kinematic chain (not shown) connecting the platform 4 to the ratchet of the barrel of the timepiece movement.

In a similar manner (but not shown), if the mechanism of FIG. 5 is provided with a regulator device comprising an inertial kinematic chain connecting the platform 4 to an inertia flywheel 50, as described above, the platform 4 also bears the toothed ring 51 of the inertial kinematic chain of the regulator device connecting this platform 4 to the inertia flywheel 50.

When the regulator device of the present invention is added to a mechanism having two rotational axes A-A and B-B such as that of FIG. 6, the platform 4 bears the toothed ring 51 of a first inertial kinematic chain connecting it to the inertia flywheel 50. The frame 30, for its part, bears a second toothed ring 51*a* of a second inertial kinematic chain connecting the frame 30 to a second inertia flywheel.

In one variation, the platform 4 and the frame 30 can be coupled using a differential, the output of which drives a single inertial kinematic chain and a single inertia flywheel, damping the accelerations of the platform 4 and frame 30.

In accordance with variations, the regulator member may be an element other than an inertia flywheel or regulation is effected simply by rotation of a mass. For example, a regulator member as used in minute repeaters (where regulation is effected by rotation of a mass and by friction of this mass on a frame), a regulator mobile with fins (where the viscosity of air is used), or a regulator mobile similar to a timepiece escapement can be used.

The invention claimed is:

1. A mechanism preventing rate variations caused by the effect of gravity on a balance-spring (2) and an escapement wheel (3) of a timepiece movement, the mechanism comprising:

a plate (1) of the timepiece movement;

a platform (4) mounted on the plate (1) so as to rotate freely about at least a first rotational axis (A-A) with respect to the plate (1) such that the platform (4) rotates about said first axis (A-A) under effect of Earth's gravity, the balance-spring (2) and the escapement wheel (3) being mounted on the platform (4) offset from the first rotational axis (A-A), at least the balance-spring (2) and the escapement wheel (3) subjecting the platform (4) to an unbalance action such that the Earth's gravity tends to position the platform (4) in a fixed reference plane;

a going train comprising i) a kinematic drive chain (M) arranged to connect the escapement wheel (3) to a barrel system (10) of the timepiece, ii) a kinematic correcting chain (C) which compensates for the displacements and speed of the platform (4) with respect to the plate (1), and iii) a third kinematic, inertial, chain independent from the kinematic drive chain (M) and from the kinematic correcting chain (C) connecting the platform (4) to the plate (1), the third kinematic inertial chain comprising an inertia regulating device (50) limiting acceleration of the platform (4) during displacements of the platform (4) under the effect of gravity when an orientation of the plate (1) is modified, the inertia regulating device (50) imparting to the platform (4) an increased rotational inertia counteracting the acceleration of the platform (4) during displacement of the platform (4) by the plate (1).

2. The mechanism as claimed in claim 1, wherein the inertia regulating device (50) comprises an inertia flywheel.

3. The mechanism as claimed in claim 2, wherein the inertia of the flywheel multiplied by the squared ratio of the kinematic inertial chain is comprised between 10 to 50 times the inertia of the platform.

4. The mechanism as claimed in claim 3, wherein the regulating device (50) is connected to the platform (4) via an inertial kinematic chain (51, 52, 53, 54) comprising at least one intermediate mobile.

5. The mechanism as claimed in claim 1, wherein the inertial kinematic chain (51, 52, 53, 54) comprises at least one intermediate mobile.

6. The mechanism as claimed in claim 5, wherein a toothed ring (51) of the inertial kinematic chain is fixedly attached to the platform (4) whilst the regulating device (50) and at least one intermediate mobile (52, 53, 54) of the inertial kinematic chain are pivoted on the plate or a bridge of the timepiece movement.

7. The mechanism as claimed in claim 5, wherein a toothed wheel of the inertial kinematic chain is fixedly attached to the plate or a bridge of the movement while the at least one intermediate mobile (52, 53, 54) of the inertial kinematic chain or the regulating device (50) are pivoted on the platform (4).

8. The mechanism as claimed in claim 1, wherein the first axis (A-A) is parallel to the rotational axis of the balance-spring (2).

9. The mechanism as claimed in claim 1, wherein the platform (4) is rotationally mounted on a frame (30) pivoted on the plate (1) or a bridge of the movement along a second axis (B-B) perpendicular to the first axis (A-A).

10. The mechanism as claimed in claim 1, wherein the platform (4) is rotationally mounted on a frame (30) pivoted on the plate (1) or a bridge of the movement along a second axis (B-B) perpendicular to the first axis (A-A); and in that the inertia regulating device comprises a differential whose inputs are connected, one to the platform (4) and the other to the frame (30), and whose output is connected by way of one or more intermediate mobiles to the regulating device (50), these intermediate mobiles or the regulating device being pivoted on the plate (1) or a bridge of the timepiece movement.

11. A timepiece comprising a mechanism as claimed in claim 1.

12. The timepiece as claimed in claim 11, further comprising an automatic winding kinematic chain connecting the platform (4) to the ratchet of the barrel system of the timepiece movement.

13. The timepiece as claimed in claim 12, wherein the platform (4) bears or forms a winding mass (55).

14. The timepiece as claimed in claim 11, wherein the platform (4) bears or forms a winding mass (55).

15. The mechanism as claimed in claim 14, wherein the regulating device (50) is connected to the platform (4) via an inertial kinematic chain (51, 52, 53, 54) comprising at least one intermediate mobile.

* * * * *